United States Patent [19]

Kolb et al.

[11] Patent Number: 4,632,232

[45] Date of Patent: Dec. 30, 1986

[54] SINGLE LEVER REMOTE CONTROL-THROTTLE DWELL AND FRICTION MECHANISM

[75] Inventors: Richard P. Kolb, Gages Lake; Anthony P. Prince, Waukegan, both of Ill.

[73] Assignee: Outboard Marine Corporation, Waukegan, Ill.

[21] Appl. No.: 627,117

[22] Filed: Jul. 2, 1984

[51] Int. Cl.[4] ..... B60K 41/02

[52] U.S. Cl. ..... 192/0.096; 192/995; 74/480 B; 74/531

[58] Field of Search ..... 192/0.096, 0.098, 995; 74/471 R, 473 R, 480 B, 503, 531; 248/73, 67.5

[56] References Cited

U.S. PATENT DOCUMENTS

| | | | |
|---|---|---|---|
| 2,534,729 | 12/1950 | Panish | 74/531 X |
| 2,771,168 | 11/1956 | Panish | 192/0.096 |
| 2,949,988 | 8/1960 | Morse | 192/0.096 |
| 3,127,785 | 4/1964 | Morse et al. | 192/0.096 X |
| 3,204,733 | 9/1965 | Morse | 192/0.096 |
| 3,223,201 | 12/1965 | Waner | 74/503 |
| 4,137,799 | 2/1979 | Olsen et al. | 192/0.096 X |

OTHER PUBLICATIONS

Modern Hanger Corp. Catalog, 1953, p. 85.

*Primary Examiner*—Rodney H. Bonck
*Assistant Examiner*—Alan G. Towner
*Attorney, Agent, or Firm*—Michael, Best & Friedrich

[57] ABSTRACT

The single lever control for operating the clutch and throttle of a marine motor has a support on which a sleeve is mounted on a pivot. A rod is mounted in the sleeve for axial movement. The distal end of the rod is actuated to move the rod and the sleeve about the pivot and also to move the rod axially relative to said sleeve. An actuating arm and a cam track cooperate to move the rod and sleeve in an arc about the pivot between first and second positions between which the clutch is operated by an operator actuated by rotation of the arm about its pivot. The actuating arm moves the rod axially relative to said sleeve when the arm is beyond the clutch operating range. The rod is connected to the throttle. A friction device acts on the rod to resist axial movement of the rod relative to the sleeve. The friction load resists change of the throttle setting but has no affect on clutch operation.

20 Claims, 6 Drawing Figures

SINGLE LEVER REMOTE CONTROL-THROTTLE DWELL AND FRICTION MECHANISM

BACKGROUND OF THE INVENTION

The clutch and throttle of marine propulsion devices (such as outboard motors) are desirably operated from a remote location also provided with steering and other controls. The operation of the clutch and throttle is controlled so the throttle is not (cannot) be advanced until after the clutch is engaged in either "forward" or "reverse". The control employs a single lever to actuate the two controls. It is desirable to permit hands-off operation without the lever moving on its own to advance or retard boat speed (throttle setting). This has been done by imposing a friction load resisting lever movement. The typical solution resists lever movement throughout its range of movement including the clutch operating range. It is not desirable to resist clutch operation. Clutch operation should be easy. And it is desirable to have the frictional resistance to change of the throttle setting adjustable by the user/operator.

Attention is directed to the following prior art:

U.S. Pat Nos. 2,966,969, 3,204,732, 3,204,733, 3,438,468, 3,511,117, 4,252,032

SUMMARY OF THE INVENTION

This invention provides a single lever control for operating the clutch and throttle of a marine engine or motor. The control has a shaft rotatably mounted on a support. A handle is mounted on the shaft to actuate a clutch for forward (F) or reverse (R) operation of the motor as the handle moves from neutral in one direction to the forward position and in the opposite direction to the reverse position. The handle is also movable to actuate the throttle as the handle continues movement past the forward or reverse positions. The clutch operator is responsive to rotation of said shaft between F and R positions to actuate the clutch. The throttle actuating apparatus is connected to the shaft and the throttle actuator is operative to impart axial movement to the actuator in response to rotation of the shaft beyond the F and R positions. The apparatus includes structure preventing axial movement of the actuator when the shaft and handle are between F and R positions. A device imposes frictional resistance to axial movement of said actuator while exerting no resistance to movement of the shaft or handle between the F and R positions.

This invention also provides a single lever control for operating the clutch and throttle of a marine motor. The control has a first member mounted on a pivot on a support. A second member is mounted for movement with the first member about said pivot and for axial movement relative to said first member. A clutch operator is movable between forward, neutral and reverse positions as the first member is moved between first and second positions. The second member is connected to and actuates the throttle when the second member moves axially. The invention also includes means for moving the second member axially relative to the first member only when the first member is moved beyond said first and second positions. Friction means resists axial movement of the second member relative to the first member.

A further feature of the invention is providing such a control in which the first member is a sleeve and the sleeve member is a rod mounted inside said sleeve. Another feature is to mount the friction means on the sleeve to engage the rod. The friction means is adjustable and resists throttle changing only. It does not resist clutch operation.

Still another feature is the provision of a single lever clutch and throttle control in which a sleeve is mounted on a first pivot on a base support. A rod is mounted in the sleeve for axial movement relative to the sleeve. The distal end of the rod is moved in an arc about the pivot between first and second positions. The clutch is operated as the sleeve moves between those positions. The sleeve is movable beyond those positions and apparatus is provided for moving the rod axially relative to the sleeve when the sleeve is beyond those positions. The rod is connected to the throttle and a friction device resists axial movement of the rod relative to the sleeve.

Another aspect of the invention is provision of a single lever clutch and throttle control for a marine motor in which a sleeve is mounted on a pivot on a base support. A rod is mounted in the sleeve for axial movement relative to the sleeve. The clutch is operated as the sleeve is moved about the pivot between first and second positions. The sleeve is movable beyond either of the first and second positions. The rod actuates the throttle when the rod moves axially and apparatus operable only when said sleeve is moved beyond the first and second positions moves the rod axially relative to the sleeve. A friction device resists axial movement of the rod relative to the sleeve.

A further feature of the invention is a single lever clutch and throttle control in which a sleeve is pivotally mounted on a support, and a throttle rod is mounted for axial movement in the sleeve and operatively connected to the engine throttle. A manually operable actuating arm is pivotally mounted on the support and is operatively connected to the distal end of the rod to swing said rod and hence the sleeve about the pivot mounting for said sleeve. The structure constrains the arm and the distal end to move between first and second positions in an arc about the pivot mounting and the clutch is operated as the arm moves between those positions. The distal end of said rod is constrained to travel with the arm in its motion about its pivot beyond those positions whereby the distal end is moved toward the pivot mounting for the sleeve and said rod is moved axially relative to the sleeve. A device is operative to impose frictional resistance to axial movement of the rod relative to the sleeve. The device imposes no resistance to movement of the rod and sleeve between the forward and reverse positions.

This invention is not limited to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DETAILED DESCRIPTION OF THE DRAWINGS

Figure 1:
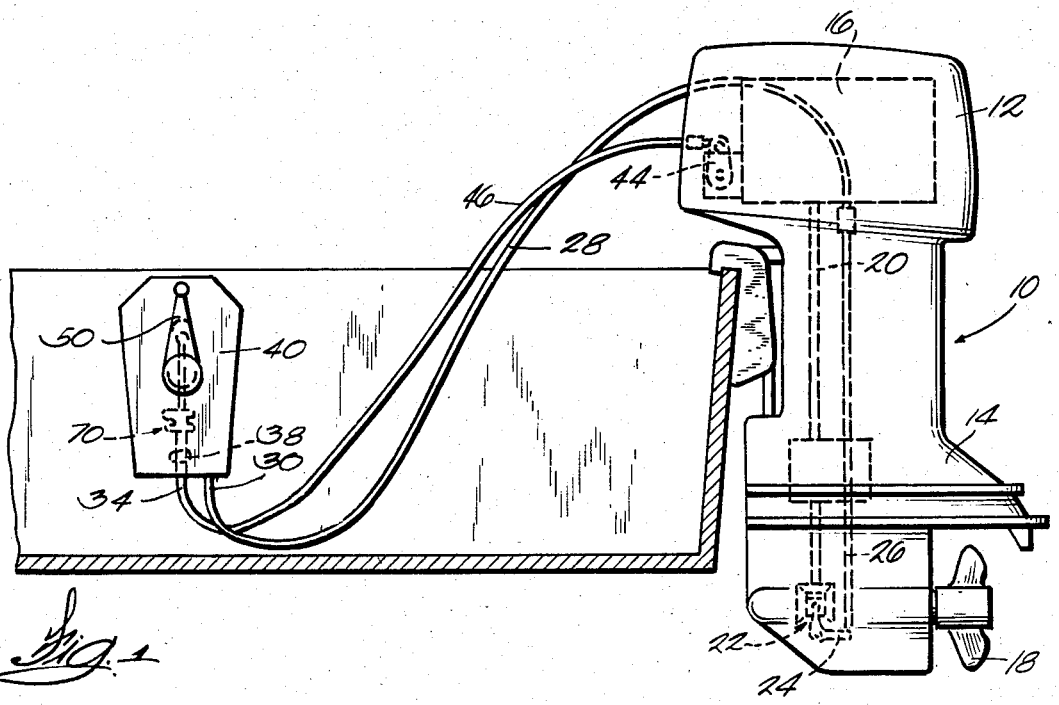
FIG. 1 is a somewhat schematic view of the manner in which the control operates the throttle and clutch of an outboard motor.
Figure 5:
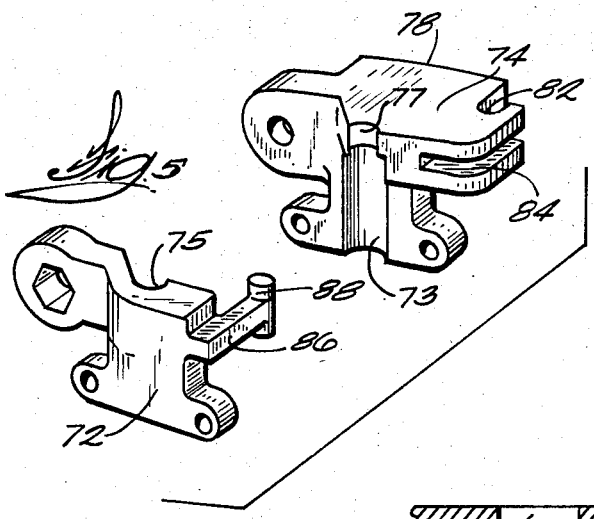
FIG. 5 is an exploded perspective view of the tube clamp and friction device incorporated in this control.
Figure 4:
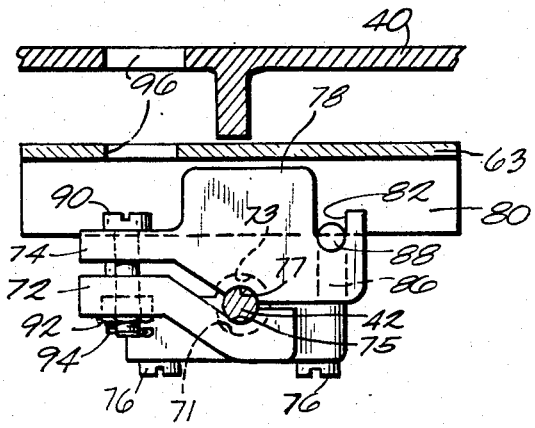
FIG. 4 is a horizontal section taken on line 4—4 of FIG. 2.
Figure 3:
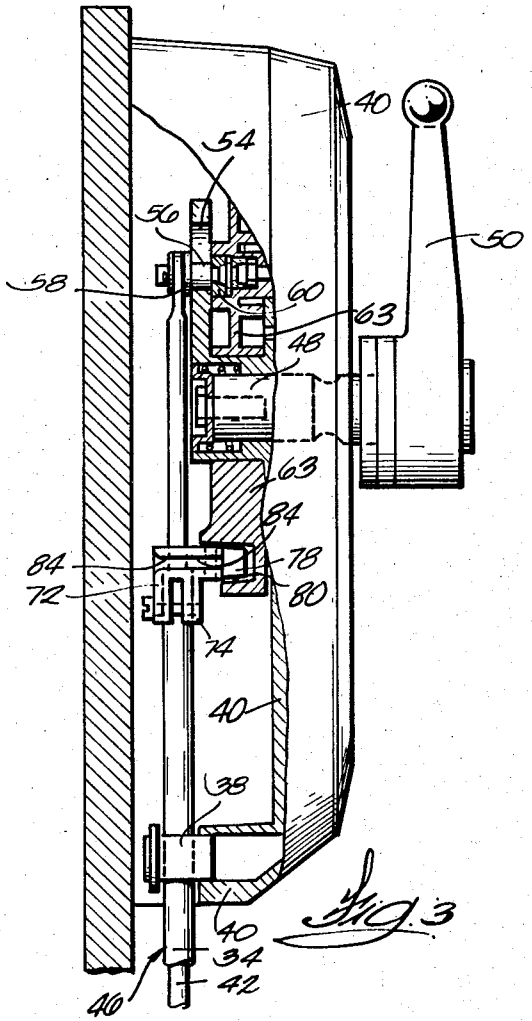
FIG. 3 is a vertical section taken on line 3—3 of FIG. 2.

The outboard motor 10 has a power head 12 on top of a lower unit 14. The power head has an engine 16 driving propeller 18 through drive shaft 20 and clutch 22. The clutch is operated by bell crank 24, link 26, and the inner core 27 of a push-pull cable 28 which also includes an outer sheath or sleeve 30. At the other end of the cable 28, the outer sheath or sleeve 30 is fixed to a journal 32 mounted on a support plate 40 for pivotal movement relative to the support plate 40 and so as to prevent axial movement of the sleeve 30.

A similar sleeve or outer sheath 34 of a second push pull cable 46 is fixed to a bushing 38 mounted on the support plate 40 for pivotal movement relative to the support plate 40 and so as to prevent axial movement of the sleeve 34. The sleeve or outer sheath 34 supports and guides an inner core or member or actuating rod 42 which is axially movable in the sleeve 34 and is connected to the throttle 44 of the engine 16. The sleeve 34 and rod 42 comprise the inner core and outer sheath of a flexible push-pull cable 46.

The support plate 40 also journals a shaft 48 on which the control handle 50 is mounted. The shaft 48 has a D-shaped end connected to actuating arm 52 to rotate the arm about the axis of shaft 48. The outer end of arm 52 has a slot 54 which receives a cylindrical bushing 56 between washer 58 and cam follower 60. Thus, the bushing 56 is constrained to move only in the slot 54.

Figure 2:
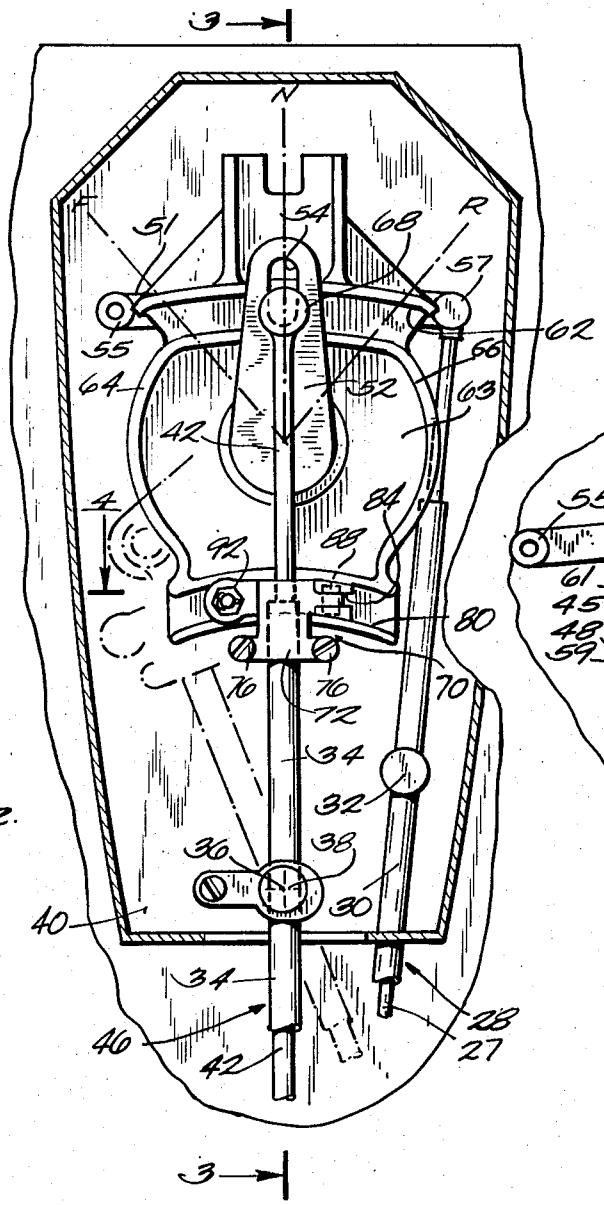
FIG. 2 is an elevation of the control from the back of the control, that is the side which would face a bulkhead or other panel on which the control is mounted.

The cam follower 60 is received in and follows the arcuate cam track 62 having pivot 38 as its center. Cam track 62 is molded in cam plate 63 which overlies the support plate 40. Cam plate 63 also has cams 64, 66 and 80 formed therein or thereon. Cam 62 confines the distal or outer end of rod 42 to movement within track 62 between the neutral (N) position illustrated in FIG. 2 and either the F or the R (forward or reverse) positions. It is in this range of movement that the operation of the clutch takes place. Since the rod 42 and sleeve 34 both are forced to swing about pivot 36 between F and R, the rod 42 cannot move axially relative to sleeve 34 and there will be no change in the throttle setting as the clutch is operated. The throttle dwells (does not change) between F and R.

Figure 6:
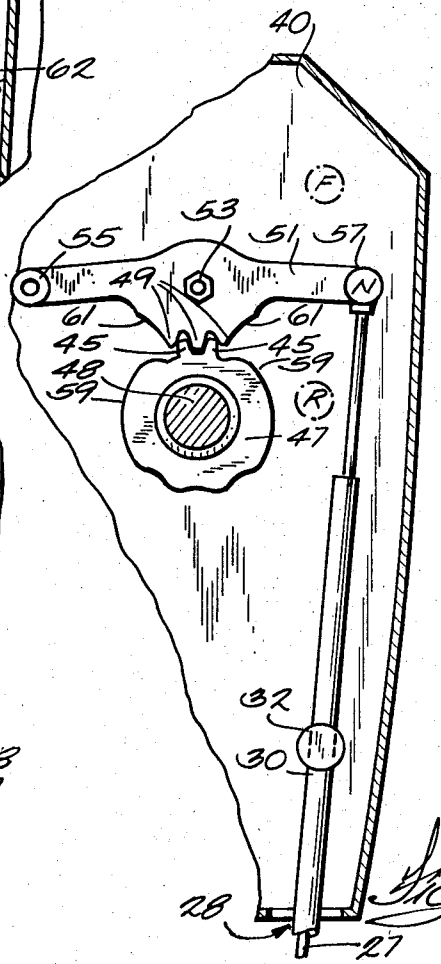
FIG. 6 is a simplified showing of the clutch actuating mechanism.

Clutch operation is controlled by teeth 45 of interrupted gear 47 engaging the teeth 49 of the shift gear 51. Gear 47 is mounted on and rotated by shaft 48 while gear 51 rotates on shaft 53. As may be seen in FIG. 6 the shift gear 51 includes laterally extending arms having bushings 55, 57 at their respective ends. Either bushing can be connected to the clutch operating push-pull cable 28. The bushing used is dictated by the installation. The shaft 48 turns gear 47 from the neutral (N) position to forward (F) or reverse (R) positions to cause the shift gear to move between the F and R positions noted in FIG. 6 to thereby shift the clutch. Further movement of the gear 47 past F or R brings one of the two smooth geneva surfaces 59, 59 on the gear 47 against a geneva surface 61 on the gear 51 to hold the shift gear against rotation while the shaft (handle) continues to rotate to actuate the throttle. It will be noted the gears 47, 51 are recessed in the base plate 40 while the cam plate 63 lies over the base plate. The shift gear can operate a switch limiting starting to neutral position. This has not been shown.

As the arm 52 swings between the F and R positions, the bushing 56 will move outwardly in the slot 54 in the arm 52. When the arm swings past the F or R position the cam follower60 will now ride on the outer or continuation cams or guides 64 or 66 on cam plate 63 and hold the distal end of the rod at the end of slot 54 in arm 52. The cams 64, 66 are arcuate and are centered on the pivot axis of the arm 52 and shaft 48. The distal end 68 of the rod 42 now travels around the center of rotation of arm 52. The arcuate path approaches the pivot 36 for the sleeve 34. The arm 52 actuating the rod over the arcuate path of the cams 64, 66 comprises means for moving the rod axially of the sleeve only in the range of movement past F and R. At its extreme motion the arm and rod will be in the position shown in dotted lines in FIG. 2, or will be in the corresponding position along cam surface 66 in the reverse range. In either event, it will be noted the rod 42 has moved axially a considerable distance relative to sleeve 34. This actuates the throttle to increase the speed of the engine 16.

Means 70 are provided for frictionally restraining movement of the inner core or rod 42 relative to the sleeve or outer sheath 34. Such means is preferably adjustible. While various other arrangements can be employed, in the disclosed construction, such means comprises clamp portions 72, 74 which have mating groovs 71 and 73 receiving the end of the sleeve 34 and which are drawn together by screws 76, to firmly clamp to the end of the sleeve 34. The clamp member 74 closer to the cam plate 63 has an integral follower 78 which projects into an arcuate track or groove 80 located on cam plate 63 (also centered on 38) to guide the clamp assembly 70 for swinging movement in the arc of the groove 80 and to prevent displacement of the friction means in the direction of movement of the inner core or rod 42. Since the distal end 68 of the rod 42 is, in effect, secured against the actuating arm 52, the follower 78 is held in the groove 80.

The clamp member 74 also includes a groove 82 on each side of a slot 84 which receives an arm 86 projecting from the clamp member 72. The arm 86 supports a cross pin 88 received in the grooves. This serves to pivot and anchor one side of clamp 72 while the other side of the clamp projects laterally to receive adjusting clamp screw 90 which passes through the clamps 74 and 72 into nut 92 which is restrained from rotation by engagement with a mating recess. The outer end of the adjusting screw 90 is provided with a cotter pin 94 preventing backing the screw out so far as to lose the nut. The clamp members 72 and 74 include respective clamping surfaces 75 and 77 which engage the rod 42. In addition, the clamping members 72 and 74 are fabricated of plastic to facilitate clamping on or squeezing the rod.

Plate 40 and the cam plate 63 are provided with an access hole 96 allowing a screwdriver to reach the adjusting screw 90 to adjust the clamping action on the rod 42. This provides for adjusting the friction load against axial movement of the rod relative to the sleeve.

It will be noted that clamps 72, 74 serve to provide for imposition of an adjustable friction load axial movement of the rod 42 relative to the sleeve 34.

The frictional load can be adjusted so the throttle setting will remain constant without the operator's hand on the handle 50. This arrangement is different from the prior art in that the friction load has no effect at all on the resistance to movement between the F and R positions in which range of movement there is no axial movement of rod 42 relative to sleeve 34. Thus, the clutch actuation remains easy and is unaffected by the resistance put on the throttle mechanism.

We claim:

1. A single lever control for operating the clutch and throttle of a marine engine, said control comprising a support, a first member mounted on a pivot on said support, a second member mounted for movement with said first member about said pivot and for axial movement relative to said first member, clutch operating means movable as said members are moved about said pivot between first and second positions, said second member being connected to the engine throttle to actuate the throttle when said second member moves axially, means operable only when said members are moved beyond said first and second positions for moving said second member axially relative to said first member, and friction means carried on said support and engageable with said second member for resisting axial movement of said second member relative to said first member.

2. A control according to claim 1 in which said first member is a sleeve and the second member is a rod mounted inside said sleeve.

3. A control according to claim 2 including means guiding said sleeve as it moves about said pivot, said guide means preventing axial movement of said sleeve.

4. A control according to claim 2 in which said friction means is fixed relative to said sleeve and engages said rod.

5. A control according to claim 4 in which the engagement of said friction means with said rod is by means of an adjustable clamp.

6. A control according to claim 5 including means operative between said first and second positions to constrain said sleeve and said rod to movement about said pivot without movement of said rod relative to said sleeve.

7. A single lever control for operating the clutch and throttle of a marine engine, said control comprising a support, a sleeve mounted on a first pivot on said support, a rod mounted in said sleeve for axial movement relative to said sleeve, said rod projecting from said sleeve, means for moving the distal end of said rod in an arc about said first pivot between first and second positions and without axial movement of said rod relative to said sleeve and for moving said distal end of rod beyond said positions, means for operating the engine clutch as said rod moves between said positions, means for moving said rod axially relative to said sleeve when said rod is moved beyond said positions, means connecting said rod to the engine throttle, and friction means carried on said support and engageable with said rod for resisting axial movement of said rod relative to said sleeve.

8. A control according to claim 7 including guide means remote from said pivot constraining movement of said sleeve to an arc about said pivot and preventing movement of said sleeve in the direction of movement of said rod.

9. A control according to claim 7 in which said friction means includes an arcuate cam having said pivot as its center, and a cam follower engaging and following said cam so as to prevent displacement of said cam follower in the direction of movement of said rod.

10. A control according to claim 9 in which said friction means comprises clamping surfaces carried by said follower and engaging said rod with adjustable friction.

11. A control according to claim 10 in which said means moving said distal end comprises a manually actuatable arm having a slot in its end and a pin on said distal end engaging said slot, a second arcuate cam having said pivot as its center, and a cam follower on said distal end engaging said second cam, the angular embrace of said second cam corresponding to movement between said positions.

12. A control according to claim 11 in which said arm moves about a second pivot and said pin is at the end of said slot when said follower reaches the end of said second cam, and including a continuation cam at each end of said second cam, each continuation cam being arcuate and centered on said second pivot to keep said pin at the end of said slot so the pin moves in an arcuate path approaching said first pivot whereby said distal end of said rod is forced to move relative to said sleeve to adjust the throttle.

13. A control according to claim 7 in which said friction means comprises clamp means carried by said sleeve and gripping said rod to resist movement of the rod relative to said sleeve.

14. A single lever control for operating the clutch and throttle of a marine engine, said control comprising a support, a sleeve mounted on a pivot on said support, a rod mounted in said sleeve for axial movement relative to said sleeve, means for operating the engine clutch as said rod is moved about said pivot between first and second positions and without axial movement of said rod relative to said sleeve, said rod being movable beyond said first and second positions and being connected to the engine throttle to actuate the throttle when said rod moves axially, means operable only when said rod is moved beyond said first and second positions for moving said rod axially relative to said sleeve, and means carried on said support and engaging said rod for frictionally resisting axial movement of said rod relative to said sleeve and for preventing displacement of said sleeve in the direction of rod axial movement.

15. A single lever clutch and throttle control for a marine engine which drives a propeller through a clutch for forward, reverse and neutral operation, said control comprising a support, a sleeve mounted on said support for movement about a first axis, a throttle rod mounted for axial movement in said sleeve and operatively connected to the engine throttle, a manually operable actuating arm mounted on said support for movement about a second axis spaced from said first axis and operatively connected to the distal end of said rod to swing said rod and hence said sleeve about said first axis, means constraining said distal end of said rod to move between first and second positions in an arc about said first axis , means for operating a clutch as said arm moves between said positions, means constraining said distal end of said rod to travel with said arm as said arm moves about said second axis beyond said positions whereby said distal end is moved toward said first axis so as to move said rod axially relative to said sleeve, and means carried on said support for imposing frictional resistance to axial movement of said rod relative to said sleeve without imposing resistance to movement of said rod and sleeve between said forward and reverse positions.

16. A control in accordance with claim 15 in which said means imposing resistance comprises clamp means acting on said rod.

17. A control in accordance with claim 16 in which said clamp means is mounted on and carried by said sleeve and engages said support to prevent movement of said clamp means in the direction of rod movement.

18. A control in accordance with claim 17 including a cam follower on said clamp means, and a cam track on said support engaged by said cam, said cam track being arcuate and centered on the pivot center of said sleeve so as to guide arcuate clamp means movement while preventing movement of said clamp means in the direction of axial rod movement.

19. A single lever control for operating the clutch and throttle of a marine engine, said control comprising a support, a handle rotatably mounted on said support to actuate a clutch for forward or reverse operation as the handle moves from neutral in one direction to the forward position and in the opposite direction to the reverse position, said handle also being movable to actuate the throttle as said handle continues movement past the forward or reverse positions, clutch operating means responsive to rotation of said handle between said positions to actuate the clutch, an axially movable throttle actuator carried by said support at a first location, throttle actuating means connected to said handle and to said actuator and including means preventing axial movement of said actuator when said handle is between said positions, said throttle actuating means being operative to impart axial movement to said actuator in response to rotation of said handle beyond said positions, and means carried on said support in spaced relation to said first location and for imposing frictional resistance to axial movement of said actuator, said frictional resistance imposing means exerting no resistance to movement of said handle between said positions.

20. A single lever control for operating the clutch and throttle of a marine engine, said control comprising a support, a pivot mounted on said support and providing a pivot axis fixed relative to said support, a first member mounted on said pivot and extending from said pivot axis, a second member extending from said pivot axis and mounted for movement with said first member about said pivot and for axial movement relative to said first member, clutch operating means movable as said members are moved about said pivot between first and second positions, said second member being connected to the engine throttle to actuate the throttle when said second member moves axially, means operable only when said first member is moved beyond said first and second positions for moving said second member axially relative to said first member, and means carried on said support in spaced relation to said pivot axis and for resisting movement of said first member in the direction of movement of said second member.

* * * * *